US011690787B2

(12) United States Patent
Lee

(10) Patent No.: US 11,690,787 B2
(45) Date of Patent: Jul. 4, 2023

(54) DRUG TRANSFER ADAPTER

(71) Applicant: Becton, Dickinson and Company, Franklin Lakes, NJ (US)

(72) Inventor: Frank Lee, Jersey City, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 17/002,299

(22) Filed: Aug. 25, 2020

(65) Prior Publication Data

US 2022/0062106 A1 Mar. 3, 2022

(51) Int. Cl.
*A61J 1/20* (2006.01)

(52) U.S. Cl.
CPC ..... *A61J 1/2096* (2013.01); *A61J 1/201* (2015.05); *A61J 1/2055* (2015.05)

(58) Field of Classification Search
CPC ..... A61J 1/2096; A61J 1/2055; A61J 1/201; A61J 1/2006; A61J 1/2048; A61J 1/1475; A61J 1/1481; A61M 5/162; A61M 25/0637
See application file for complete search history.

(56) References Cited

U.S. PATENT DOCUMENTS 3,822,700 A 7/1974 Pennington
4,079,738 A * 3/1978 Dunn ..... A61M 25/0606 604/164.05
4,423,819 A * 1/1984 Cummings ..... B32B 15/08 215/254
4,515,283 A 5/1985 Suzuki
4,629,159 A 12/1986 Wellenstam
4,695,276 A 9/1987 Shinno et al.
4,851,006 A 7/1989 Tuke
5,211,638 A 5/1993 Dudar et al.
5,334,179 A * 8/1994 Poli ..... A61J 1/2089 604/411
5,368,177 A 11/1994 Derksen
5,520,420 A 5/1996 Moretti
5,569,222 A 10/1996 Haselhorst et al.
(Continued)

FOREIGN PATENT DOCUMENTS

EP 0728490 A2 8/1996
JP 9131405 A 5/1997
(Continued)

OTHER PUBLICATIONS

Online Catalog Page from Millpledge http://www.millpledge.com/PBSCProduct.asp?ItmID=13073828.
(Continued)

*Primary Examiner* — Erich G Herbermann
*Assistant Examiner* — Alessandro R Del Priore
(74) *Attorney, Agent, or Firm* — The Webb Law Firm

(57) ABSTRACT

A drug transfer adapter includes a body having a first end and a second end positioned opposite the first end, a transfer spike extending from the body and defining an opening, with the transfer spike configured to pierce a closure of a container, a connector extending from the body, and a securing member extending from the body. The securing member has a first side and a second side positioned opposite the first side, with the first side of the securing member including an adhesive surface configured to secure the body to a container.

20 Claims, 12 Drawing Sheets

(56) References Cited

U.S. PATENT DOCUMENTS

| | | | | |
|---|---|---|---|---|
| 5,755,697 | A | 5/1998 | Jones et al. | |
| 5,810,792 | A * | 9/1998 | Fangrow, Jr. | A61M 39/045 604/533 |
| 5,839,715 | A * | 11/1998 | Leinsing | A61M 39/045 604/905 |
| 6,253,804 | B1 * | 7/2001 | Safabash | A61J 1/2096 604/416 |
| 7,757,901 | B2 * | 7/2010 | Welp | B05B 11/0032 222/323 |
| 8,075,550 | B2 | 12/2011 | Nord et al. | |
| 9,283,324 | B2 * | 3/2016 | Lev | A61J 1/2096 |
| 9,550,024 | B2 | 1/2017 | Hanner et al. | |
| 2003/0191445 | A1 | 10/2003 | Wallen et al. | |
| 2005/0182383 | A1 | 8/2005 | Wallen | |
| 2005/0215976 | A1 | 9/2005 | Wallen | |
| 2005/0245867 | A1 | 11/2005 | Olsen et al. | |
| 2005/0245899 | A1 | 11/2005 | Swisher | |
| 2006/0200093 | A1 | 9/2006 | Lopez | |
| 2007/0088252 | A1 * | 4/2007 | Pestotnik | A61M 39/223 604/82 |
| 2009/0204080 | A1 | 8/2009 | Balteau et al. | |
| 2009/0216212 | A1 * | 8/2009 | Fangrow, Jr. | A61J 1/2096 604/406 |
| 2010/0218846 | A1 | 9/2010 | Kriheli | |
| 2011/0049866 | A1 | 3/2011 | Trombley, III et al. | |
| 2011/0062703 | A1 * | 3/2011 | Lopez | A61M 39/22 285/129.1 |
| 2014/0150911 | A1 | 6/2014 | Hanner et al. | |
| 2015/0011963 | A1 | 1/2015 | Fangrow | |
| 2016/0199569 | A1 | 7/2016 | Yevmenenko et al. | |
| 2017/0333286 | A1 | 11/2017 | Phipps | |
| 2018/0339146 | A1 * | 11/2018 | Schrauder | A61M 5/281 |
| 2019/0110953 | A1 * | 4/2019 | Deck | A61M 5/1782 |
| 2020/0238071 | A1 * | 7/2020 | Naygauz | A61J 1/10 |
| 2020/0276084 | A1 | 9/2020 | Denenburg | |

FOREIGN PATENT DOCUMENTS

| | | | |
|---|---|---|---|
| JP | 10290842 | A | 11/1998 |
| JP | 200211097 | A | 1/2002 |
| JP | 2003534877 | A | 11/2003 |
| JP | 2003339821 | A | 12/2003 |
| JP | 2005169113 | A | 6/2005 |
| JP | 2005522281 | A | 7/2005 |
| JP | 2007236438 | A | 9/2007 |
| JP | 2009233286 | A | 10/2009 |
| JP | 201063866 | A | 3/2010 |
| WO | 9119462 | | 12/1991 |
| WO | 2010069361 | A1 | 6/2010 |
| WO | 2011014525 | A2 | 2/2011 |

OTHER PUBLICATIONS

Online Catalog Page from Vitality Medical https://www.vitalitymedical.com/iv-access-spike.html network=g&device=c&keyword=&campaign=1014818849&adgroup=pla-341389485770&gclid=EA1aIQobChMIgcWa1lHr6QIVzcDACh2GzA_xEAQYBCABEglq4fD_BwE.

* cited by examiner

DRUG TRANSFER ADAPTER

BACKGROUND OF THE INVENTION

Field of the Disclosure

The present disclosure relates generally to a drug transfer adapter and, more particularly, a drug transfer adapter with a securing member.

Description of the Related Art

Health care providers reconstituting, transporting, and administering hazardous drugs, such as cancer treatments, can put health care providers at risk of exposure to these medications and present a hazard in the health care environment. Unintentional chemotherapy exposure can affect the nervous system, impair the reproductive system, and bring an increased risk of developing blood cancers in the future. Some drugs must be dissolved or diluted before they are administered, which involves transferring a solvent from one container to a sealed vial containing the drug in powder or liquid form, by means of a needle. Drugs may be inadvertently released into the atmosphere in gas form or by way of aerosolization, during the withdrawal of the needle from the vial and while the needle is inside the vial if any pressure differential between the interior of the vial and the surrounding atmosphere exists. In order to reduce the risk of health care providers being exposed to toxic drugs, the transfer of these drugs is accomplished utilizing a closed system transfer device or system. Closed system transfer devices or systems may include syringe adapters, patient connectors, IV bag spikes, and vial adapter.

SUMMARY OF THE INVENTION

In one aspect or embodiment, a drug transfer adapter includes a body having a first end a second end positioned opposite the first end, a transfer spike extending from the body and defining an opening, with the transfer spike configured to pierce a closure of a container, a connector extending from the body, and a securing member extending from the body. The securing member has a first side and a second side positioned opposite the first side, with the first side of the securing member including an adhesive surface configured to secure the body to a container.

The securing member may include an extension portion extending from the body, a tapered portion extending from the extension portion, and a rectangular portion extending from the tapered portion. The rectangular portion may be wider than the extension portion. The securing member may be flexible. The transfer spike may extend from the first end of the body. The connector extend from the second end of the body. The body may be rectangular, with the body including a first grip surface and a second grip surface positioned opposite the first grip surface. The first and second grip surfaces may each be arcuate. The body may be disc-shaped.

The body may be cylindrical with a sidewall extending between the first end and the second end of the body. The connector may extend from the body at a position intermediate the first and second ends of the body. The body may include a first grip surface and a second grip surface positioned opposite the first grip surface, with the first and second grip surfaces each being arcuate. The securing member may include an extension portion extending from the body, a tapered portion extending from the extension portion, and a rectangular portion extending from the tapered portion, with the extension portion of the securing member extending along the sidewall of the body. The adhesive surface of the extension portion of the securing member is in contact with the sidewall of the body to secure the securing member to the body.

The securing member may include a first securing member and a second securing member positioned opposite the first securing member. The first securing member and the second securing member may be formed integrally. The first securing member and the second securing member may define an opening that receives the connector, with a portion of the adhesive surface of the first side of the first and second securing members in contact with the body to secure the first and second securing members to the body.

The securing member may have a length of at least 50 percent of a length of the transfer spike. The securing member may have a length of at least 90 percent of a length of the transfer spike.

BRIEF DESCRIPTION OF THE DRAWINGS

The above-mentioned and other features and advantages of this disclosure, and the manner of attaining them, will become more apparent and the disclosure itself will be better understood by reference to the following descriptions of aspects of the disclosure taken in conjunction with the accompanying drawings, wherein.

Corresponding reference characters indicate corresponding parts throughout the several views. The exemplifications set out herein illustrate exemplary aspects of the disclosure, and such exemplifications are not to be construed as limiting the scope of the disclosure in any manner.

DETAILED DESCRIPTION

Figure 1:
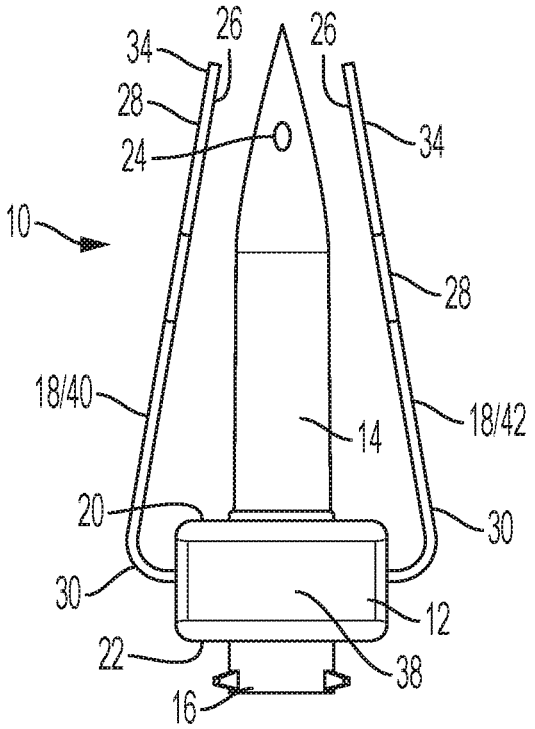
FIG. 1 is a front view of a drug transfer adapter according to one aspect or embodiment of the present application.

The following description is provided to enable those skilled in the art to make and use the described aspects contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary aspects of the invention. Hence, specific dimensions and other physical characteristics related to the aspects disclosed herein are not to be considered as limiting.

Figure 2:
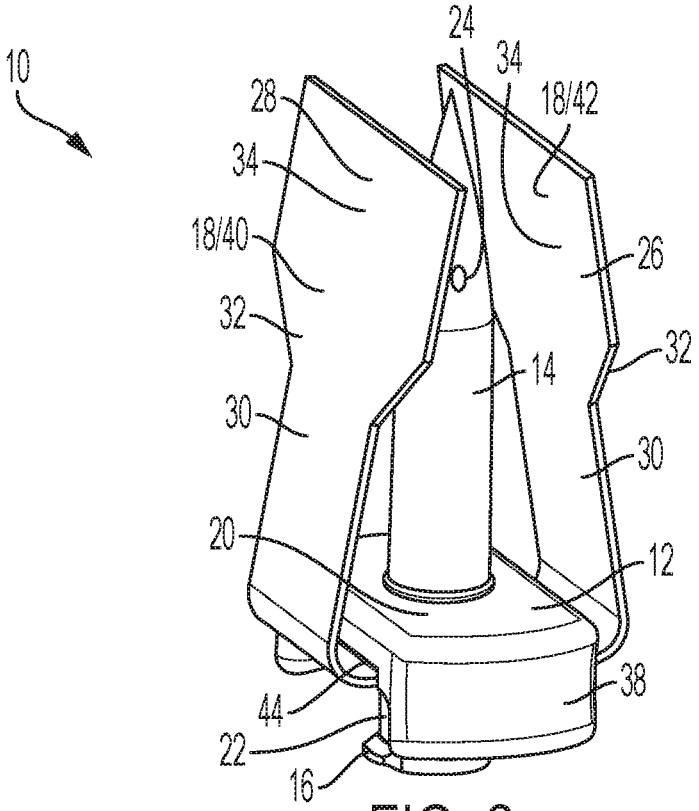
FIG. 2 is a perspective view of the drug transfer adapter of FIG. 1, showing a first position of a securing member.
Figure 3:
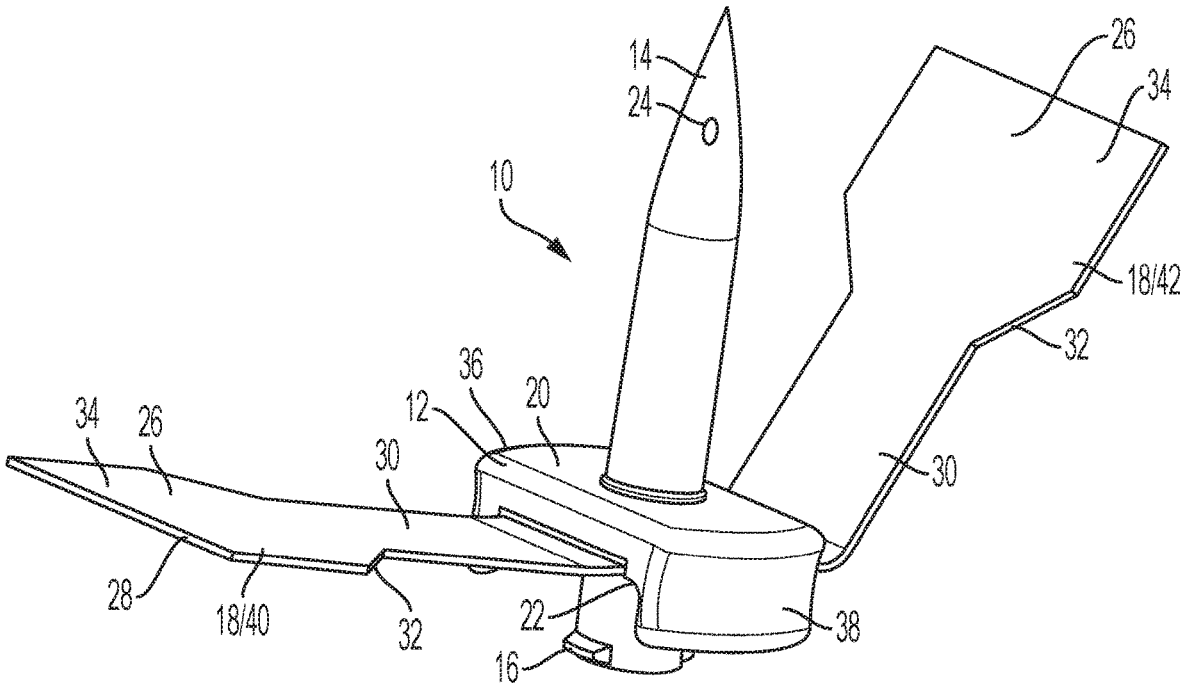
FIG. 3 is a perspective view of the drug transfer adapter of FIG. 1, showing a second position of a securing member.

Referring to FIGS. 1-3, a drug transfer adapter 10 according to one aspect or embodiment includes a body 12, a transfer spike 14 extending from the body 12, a connector 16 extending from the body 12, and a securing member 18 extending from the body 12. The body 12 has a first end 20 and a second end 22 positioned opposite the first end 20. The transfer spike 14 defines an opening 24, with the transfer spike 14 configured to pierce a closure of a container. The connector 16 is configured to connect to a syringe barrel or syringe adapter. The securing member 18 has a first side 26 and a second side 28 positioned opposite the first side 26. The first side 26 of the securing member 18 includes an adhesive surface configured to secure the body 12 to a container. The opening 24 of the transfer spike 14 is in fluid communication with the connector 16 to allow the transfer of fluid through the transfer spike 14, through the connector 16, and into a component connected to the connector 16. The drug transfer adapter 10 is configured to transfer medicament or fluid from one container, such as a syringe, to another container, such as an IV bag, IV bottle, vial, etc. In one aspect or embodiment, the drug transfer adapter 10 is an IV bag adapter and configured to be connected to a syringe adapter and a spike port of an IV bag.

Referring again to FIGS. 1-3, the securing member 18 comprises an extension portion 30 extending from the body 12, a tapered portion 32 extending from the extension portion 30, and a rectangular portion 34 extending from the tapered portion 32. The rectangular portion 34 is wider than the extension portion 30, which increases the surface area of the securing member 18 thereby increasing the adhesive surface area of the first side 26 of the securing member 18. Although the rectangular portion 34 is shaped like a rectangle, other suitable shapes and configurations may be utilized. The securing member 18 is flexible and configured to allow the securing member 18 to be wrapped around a container or a portion of a container, such a spike port of an IV bag, to secure the drug transfer adapter 10 to the container. The securing member 18 has a first position, shown in FIG. 2, to allow the securing member 18 to be secured to a container and a second position, shown in FIG. 3, to allow the transfer spike 14 to pierce a container without interference from the securing member 18. The securing member 18 may be moveable 90 degrees when moving from the first position to the second position and vice versa, although other suitable angles may utilized. In one aspect or embodiment, the securing member 18 is formed from adhesive tape, such as adhesive foil, although other suitable arrangements may be utilized. In one aspect or embodiment, the securing member 18 includes a liner that is peeled off prior to using the securing member 18. In one aspect or embodiment, the securing member is formed from medical grade laminated foil with adhesive on a single side covered by a removable liner, such 3M™ 9792R aluminum foil tap available from 3M Company, although other suitable tapes may be utilized. In one aspect or embodiment, the securing member 18 is configured to permanently or semi-permanently secure the drug transfer adapter 10 to a container such that the drug transfer adapter 10 cannot be easily removed from the container.

The transfer spike 14 extends from the first end 20 of the body 12 and the connector 16 extends from the second end 22 of the body 12, although other suitable arrangements may be utilized. In one aspect or embodiment, the transfer spike 14 may be positioned at a right angle relative to the connector 16. The body 12 is rectangular, although other suitable shapes and configurations may be utilized. The body 12 includes a first grip surface 36 and a second grip surface 38 positioned opposite the first grip surface 36. During use of the drug transfer adapter 10, a healthcare worker can grasp the first and second grip surfaces 36, 38 and pierce a container with the transfer spike 14. The first and second grip surfaces 36, 38 are arcuate, although other suitable shapes and configurations may be utilized.

Referring again to FIGS. 1-3, the drug transfer adapter 10 includes two securing members 18, with a first securing member 40 positioned opposite a second securing member 42. The first securing member 40 the second securing member 42 are formed integrally, although other suitable configurations may be utilized. The first securing member 40 and the second securing member 42 define an opening 44 that receives the connector 16. A portion of the adhesive surface of the first side 26 of the first and second securing members 40, 42 is in contact with the body 12 to secure the first and second securing members 40, 42 to the body.

In one aspect or embodiment, the securing member 18 has a length of at least 50 percent of a length of the transfer spike 14. In a further aspect or embodiment, the securing member 18 has a length of at least 90 percent of a length of the transfer spike 14. The securing member may be long enough and have sufficient surface area to provide sufficient adhesion to increase the force required to remove the drug transfer adapter 10 from a container while not being too long to cause un-adhered sections or imperfections of the securing member 18 that could compromise the strength of the interface between the securing member 18 and the container.

Figure 4:
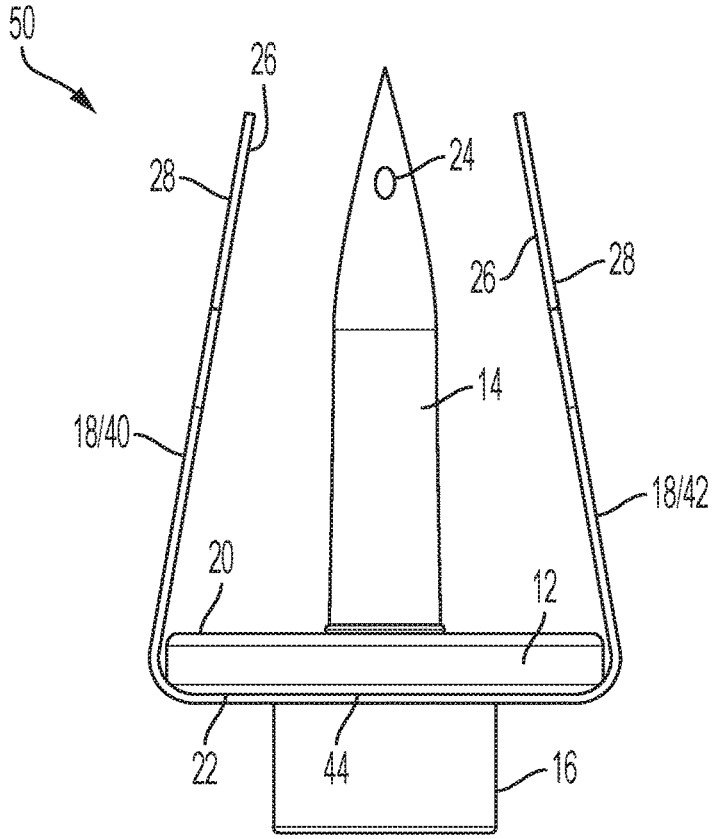
FIG. 4 is a front view of a drug transfer adapter according to a second aspect or embodiment of the present application.
Figure 5:
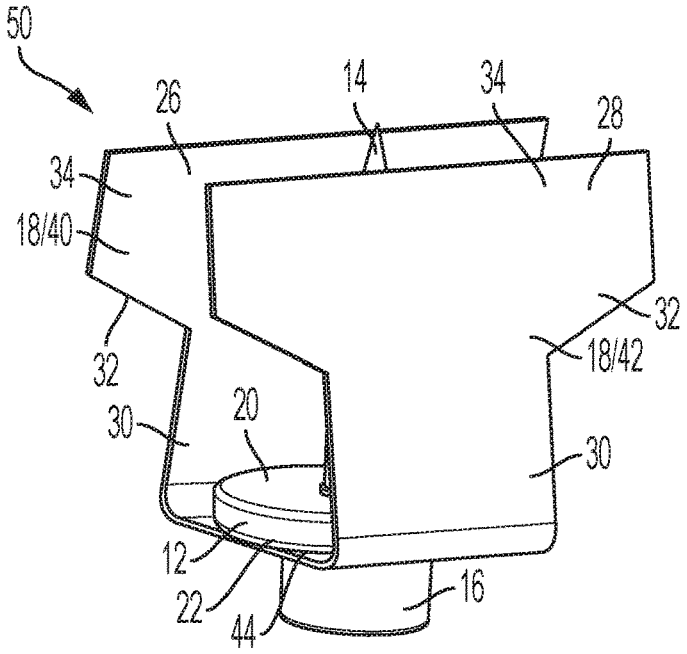
FIG. 5 is a perspective view of the drug transfer adapter of FIG. 4, showing a first position of a securing member.
Figure 6:
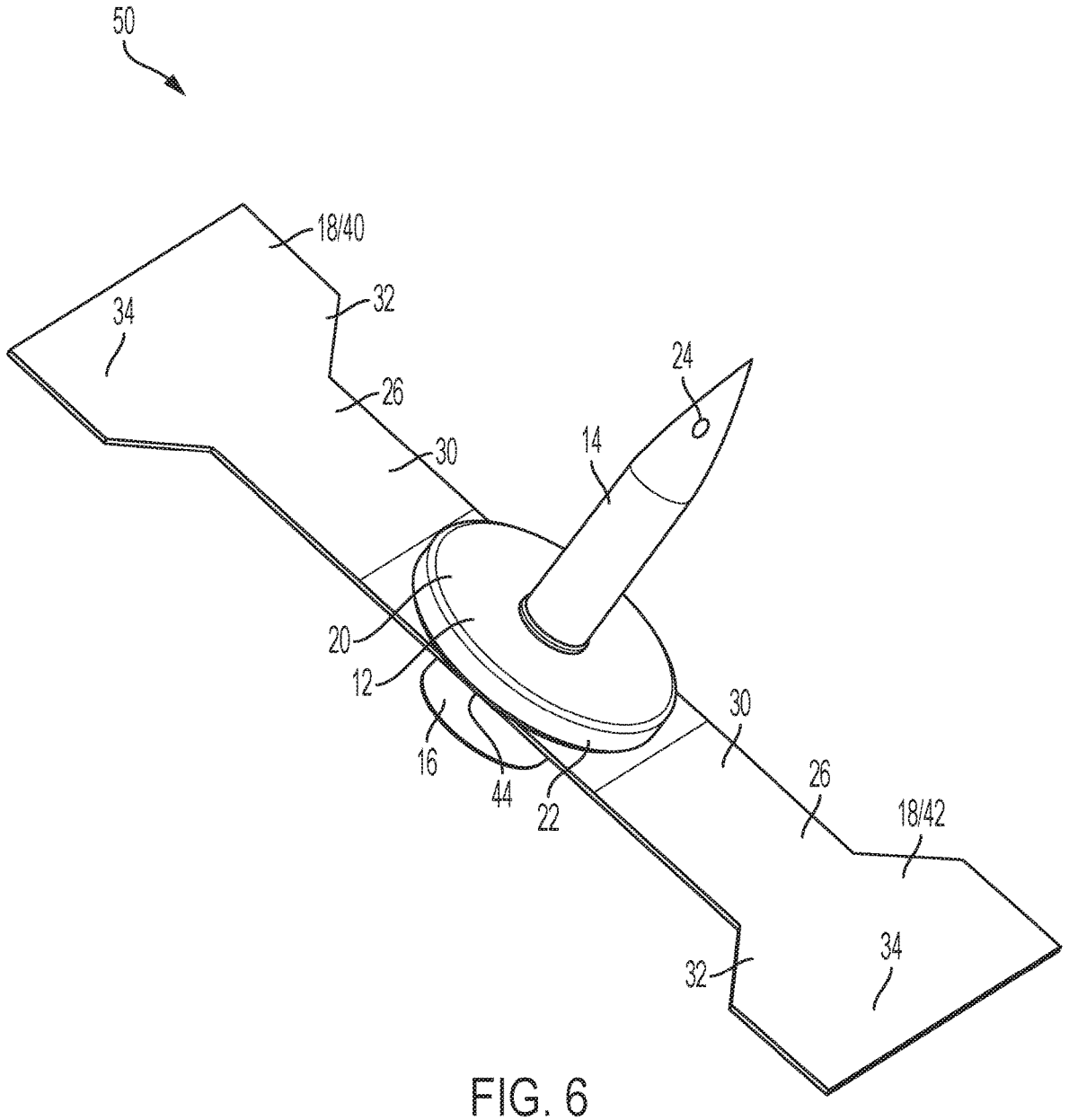
FIG. 6 is a perspective view of the drug transfer adapter of FIG. 4, showing a second position of a securing member.
Figure 7:
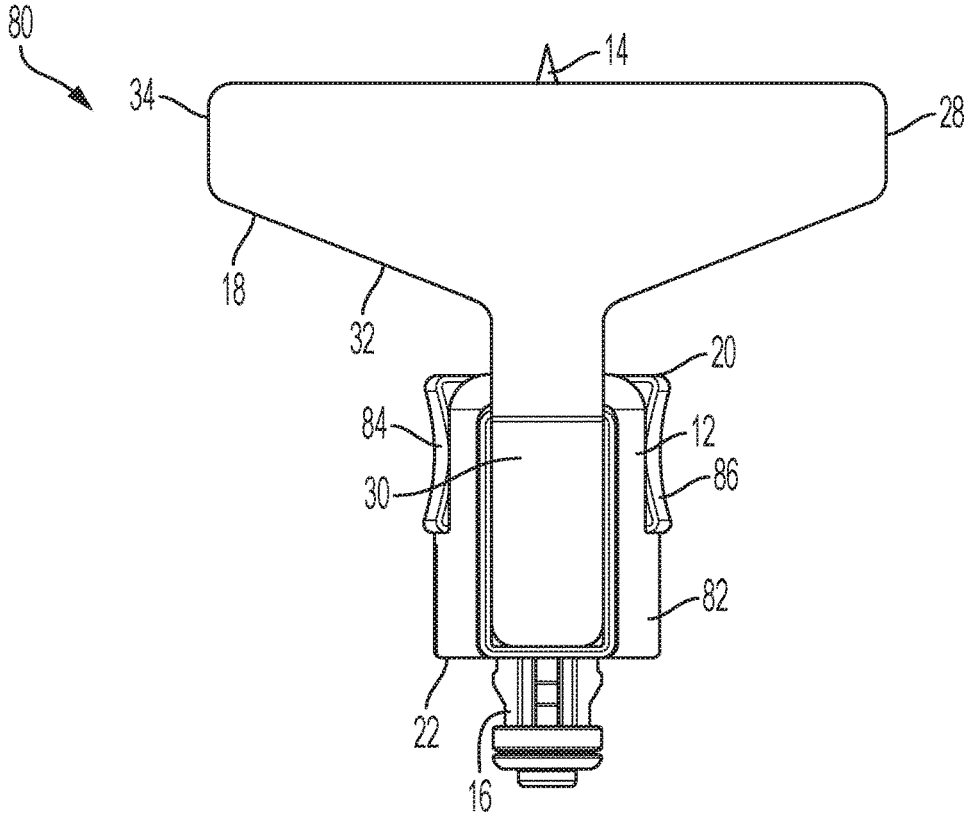
FIG. 7 is a front view of a drug transfer adapter according to a third aspect or embodiment of the present application.
Figure 8:
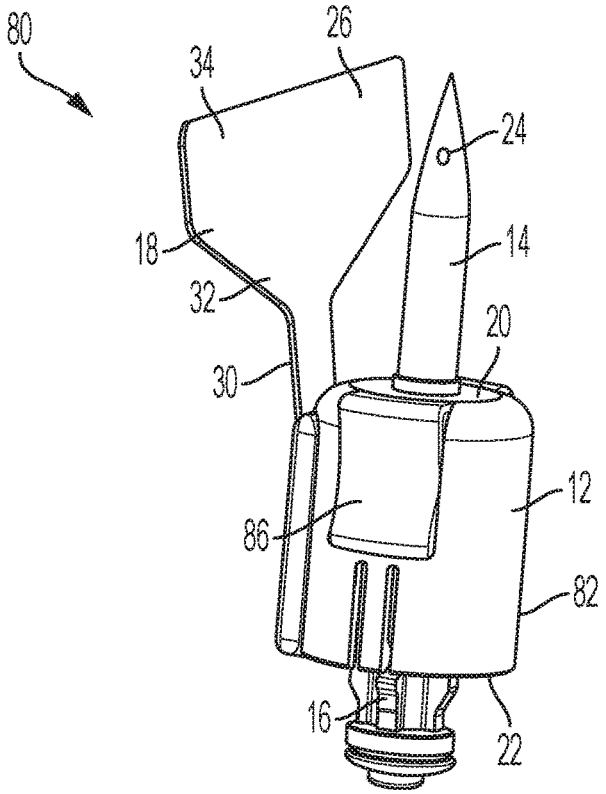
FIG. 8 is a perspective view of the drug transfer adapter of FIG. 7, showing a first position of a securing member.

Referring to FIGS. 4-6, a drug transfer adapter 50 according to a second aspect or embodiment is shown. The drug transfer adapter 50 is similar to the drug transfer adapter 10 shown in FIGS. 1-3, except the body 12 is disc-shaped, the extension portion 30 of each securing member 18 is shorter, and the rectangular portion 34 is wider.

Referring to FIGS. 7-11, a drug transfer adapter 80 according to a third aspect or embodiment is shown. The drug transfer adapter 80 is similar to the drug transfer adapter 10 in FIGS. 1-3, except for the differences discussed below. The drug transfer adapter 80 only includes a single securing member 18. The body 12 is cylindrical with a sidewall 82 extending between the first end 20 and the second end 22 of the body 12. The connector 16 extends from the body 12 at a position intermediate the first and second ends 20, 22 of the body 12. The body 12 includes a first grip surface 84 and a second grip surface 86 positioned opposite the first grip surface 84, with the first and second grip surfaces 84, 86 being arcuate. The extension portion 30 of the securing member 18 extends along the sidewall 82 of the body 12. The adhesive surface of the extension portion 30 of the securing member 18 is in contact with the sidewall 82 of the body 12 to secure the securing member 18 to the body 12.

Figure 10:
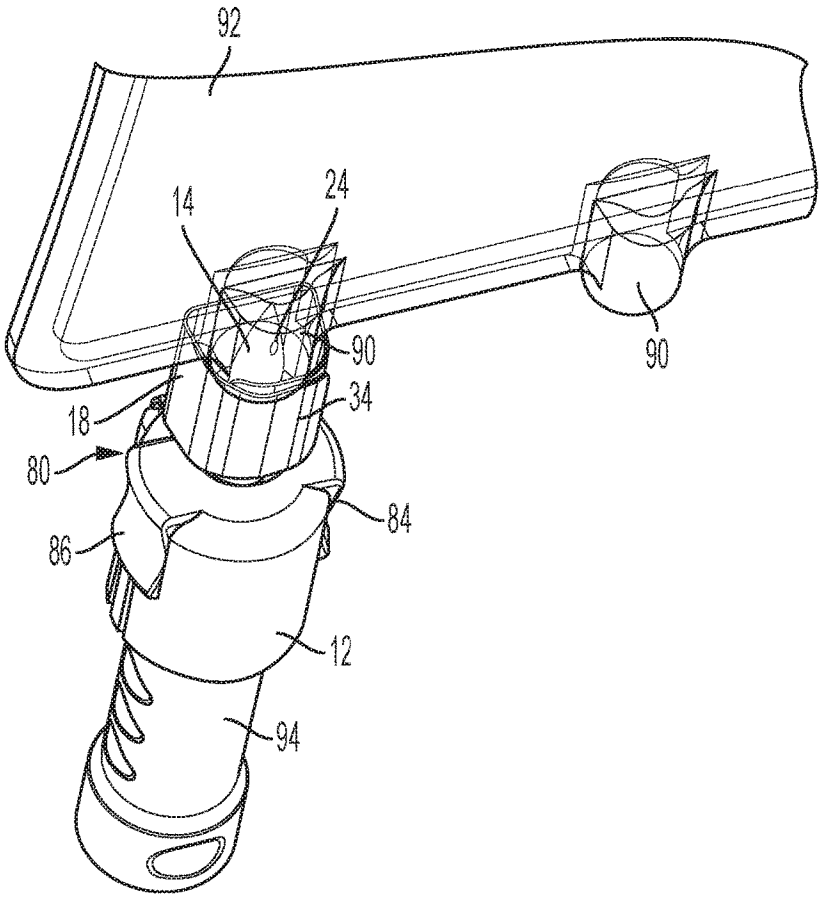
FIG. 10 is a partial perspective view of the drug transfer adapter of FIG. 7, showing the drug transfer adapter in use with an infusion container.
Figure 9:
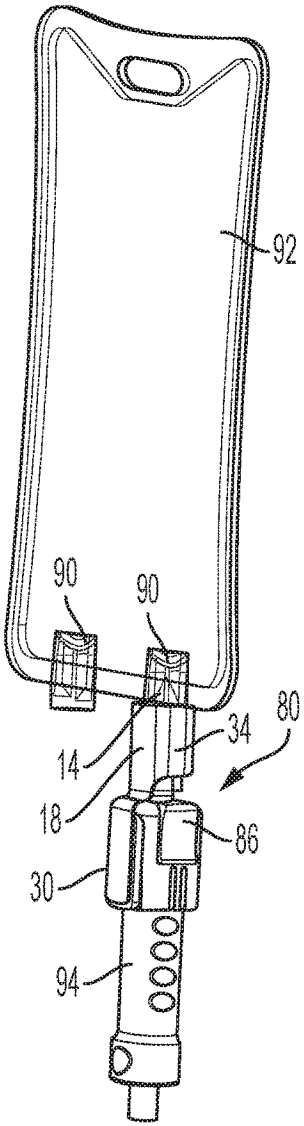
FIG. 9 is a perspective view of the drug transfer adapter of FIG. 7, showing the drug transfer adapter in use with an infusion container.
Figure 11:
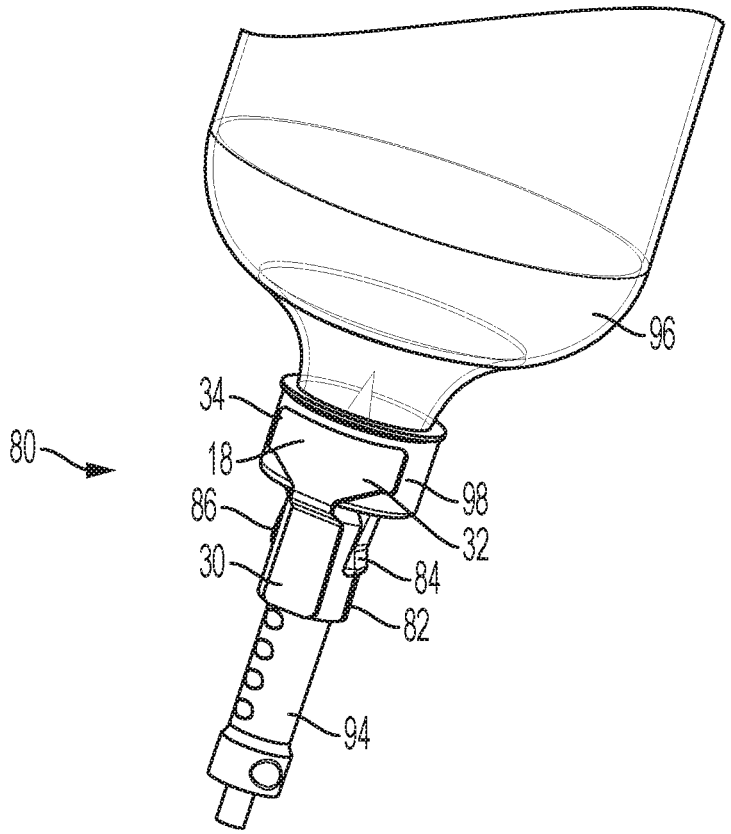
FIG. 11 is a partial perspective view of the drug transfer adapter of FIG. 7, showing the drug transfer adapter in use with a drug vial.

Referring to FIGS. 9-11, the drug transfer adapter 80 is shown secured to a spike port 90 of an IV bag 92 (FIGS. 9 and 10) as well as a drug vial or container 96 (FIG. 11). As shown in FIGS. 9 and 10, the transfer spike 14 pierces a closure of the spike port 90 with at least a portion of the transfer spike 14 received within the spike port 90. After the transfer spike 14 is inserted into the spike port 90, the securing member 18, particularly the rectangular portion 34 of the securing member 18, is wrapped around the spike port 90 of the IV bag 92 to secure the drug transfer adapter 80 to the IV bag 92 via engagement of the adhesive surface on the first side 26 of the securing member 18 with the spike port 90. A syringe adapter 94 is secured to the connector 16 such that the IV bag 92 is in fluid communication with the syringe adapter 94 via the transfer spike 14, the body 12, and the connector 16. The sidewall 82 of the body 12 surrounds a portion of the syringe adapter 94 when the syringe adapter 94 is secured to the connector 16. A syringe barrel (not shown) may be secured to the syringe adapter 94. The syringe adapter 94 may be the same and operate in the same manner as the syringe adapter shown and described in United States Patent Application Publication No. 2015/0297454, which is hereby incorporated by reference in its entirety. As shown in FIG. 11, the drug transfer adapter 80 is connected to the drug vial 96 in a similar manner as it connects to the IV bag 92. The transfer spike 14 pierces a closure of the drug vial 96 such that the transfer spike 14 is in fluid communication with the drug vial 96 and the rectangular portion 34 of the securing member 18 is pressed onto a portion, such as a cap 98, of the drug vial 96 to secure the drug transfer adapter 80 to the drug vial 96 via engagement of the adhesive surface on the first side 26 of the securing member 18 with the drug vial 96.

Figure 12:
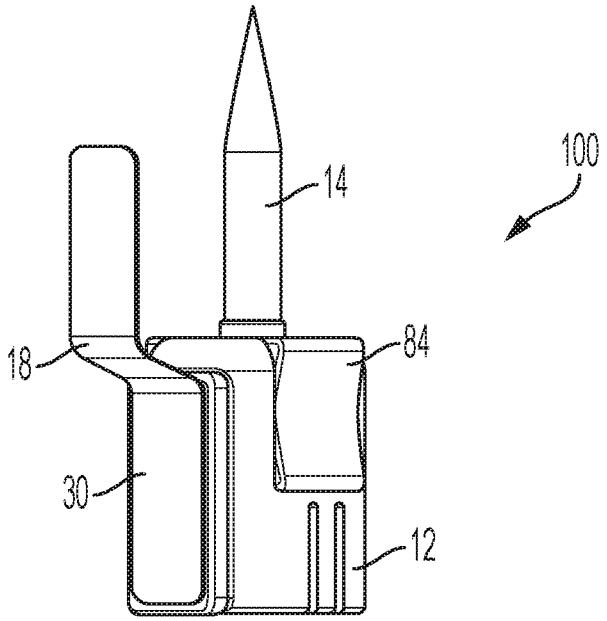
FIG. 12 is a side view of a drug transfer adapter according to a fourth aspect or embodiment of the present application.
Figure 13:
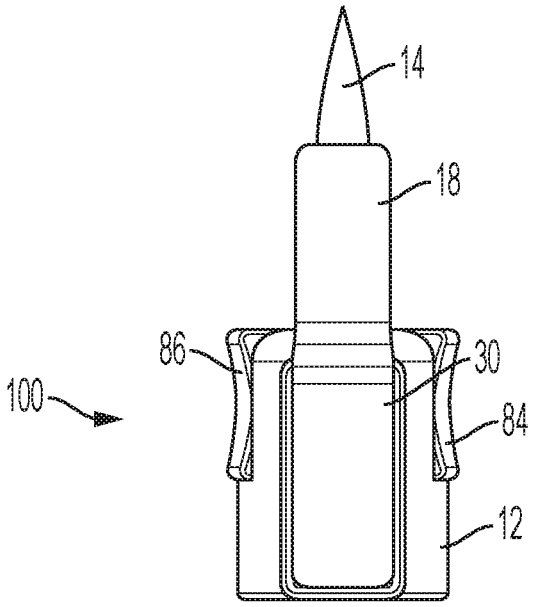
FIG. 13 is a front view of the drug transfer adapter of FIG. 12.
Figure 14:
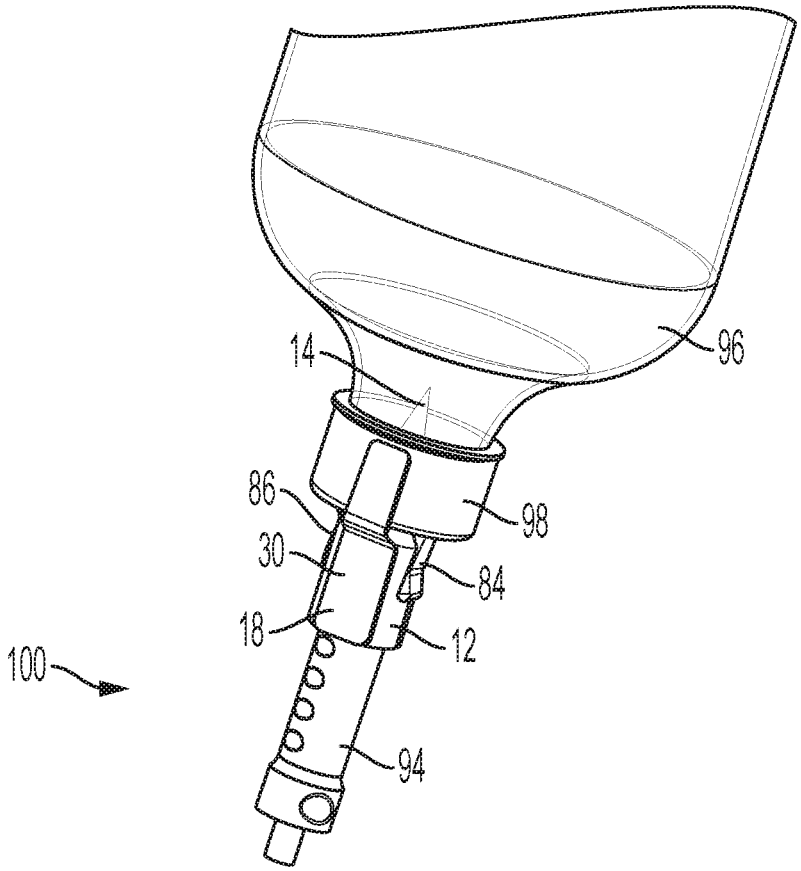
FIG. 14 is a partial perspective view of the drug transfer adapter of FIG. 12, showing the drug transfer adapter in use with a drug vial.

Referring to FIGS. 12-14, a drug transfer adapter 100 according to a fourth aspect or embodiment is shown. The drug transfer adapter 100 is similar to the drug transfer adapter 80 in FIGS. 7-11, except for the differences discussed below. The securing member 18 of the drug transfer adapter 100 only includes the extension portion 30. In other words, the single securing member 18 is rectangular. As shown in FIG. 14, the drug transfer adapter 100 is connected to the drug vial 96 in a similar manner as the drug transfer adapter 80 discussed above and shown in FIG. 11. The transfer spike 14 pierces a closure of the drug vial 96 such that the transfer spike 14 is in fluid communication with the drug vial 96 and the extension portion 30 of the securing member 18 is pressed onto a portion of the drug vial 96 to secure the drug transfer adapter 100 to the drug vial 96 via engagement of the adhesive surface of the securing member 18 with the drug vial 96.

Figure 15:
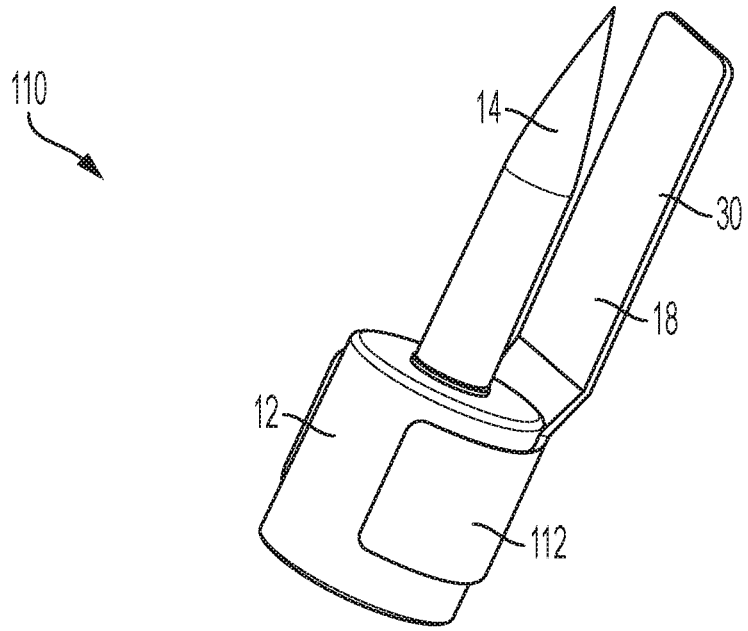
FIG. 15 is a perspective view of a drug transfer adapter according to a fifth aspect or embodiment of the present application.
Figure 16:
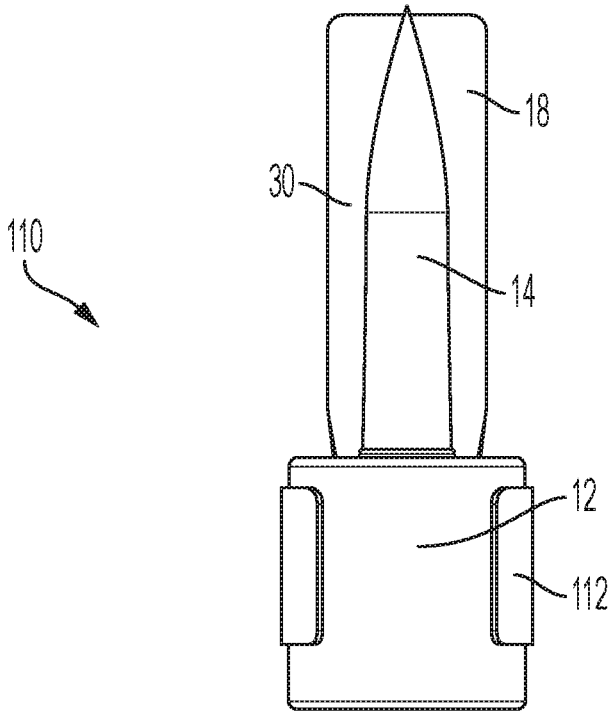
FIG. 16 is a rear view of the drug transfer adapter of FIG. 15.

Referring to FIGS. 15 and 16, a drug transfer adapter 110 according to a fifth aspect or embodiment is shown. The drug transfer adapter 110 is similar to the drug transfer adapter 100 in FIGS. 12-14, except for the differences discussed below. The securing member 18 further includes an attachment portion 112 extending perpendicularly from the extension portion 30 of the securing member 18. The attachment portion 112 provides an additional surface area to further ensure the attachment of the securing member 18 to the body 12 of the drug transfer adapter 110. The attachment portion 112 is rectangular, although other suitable shapes and configurations may be utilized.

Figure 17:
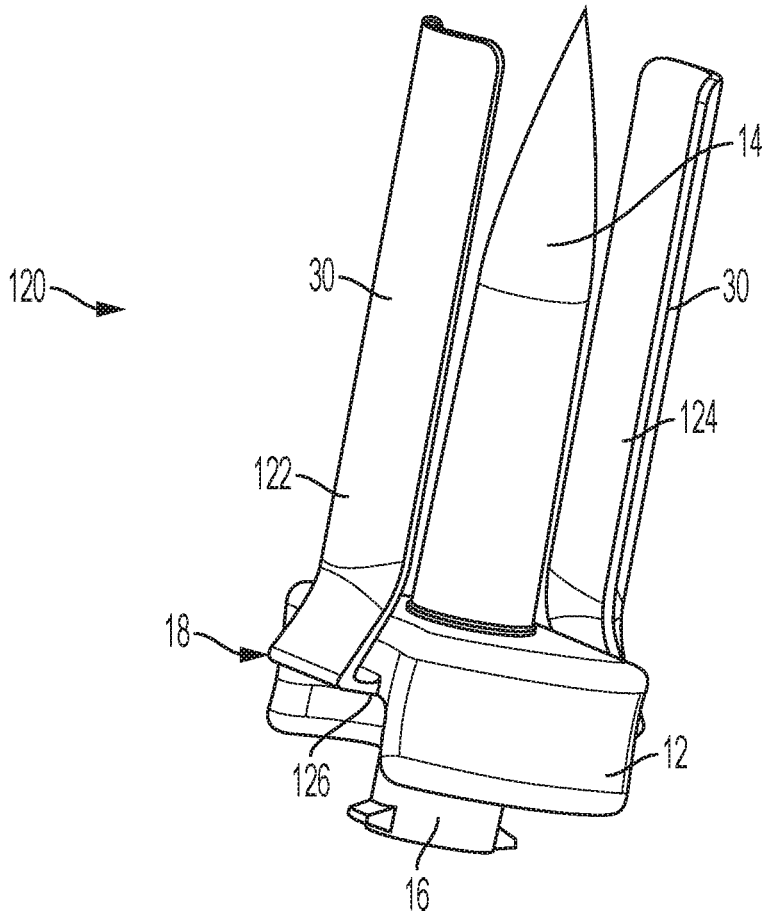
FIG. 17 is a perspective view of a drug transfer adapter according to a sixth aspect or embodiment of the present application.
Figure 18:
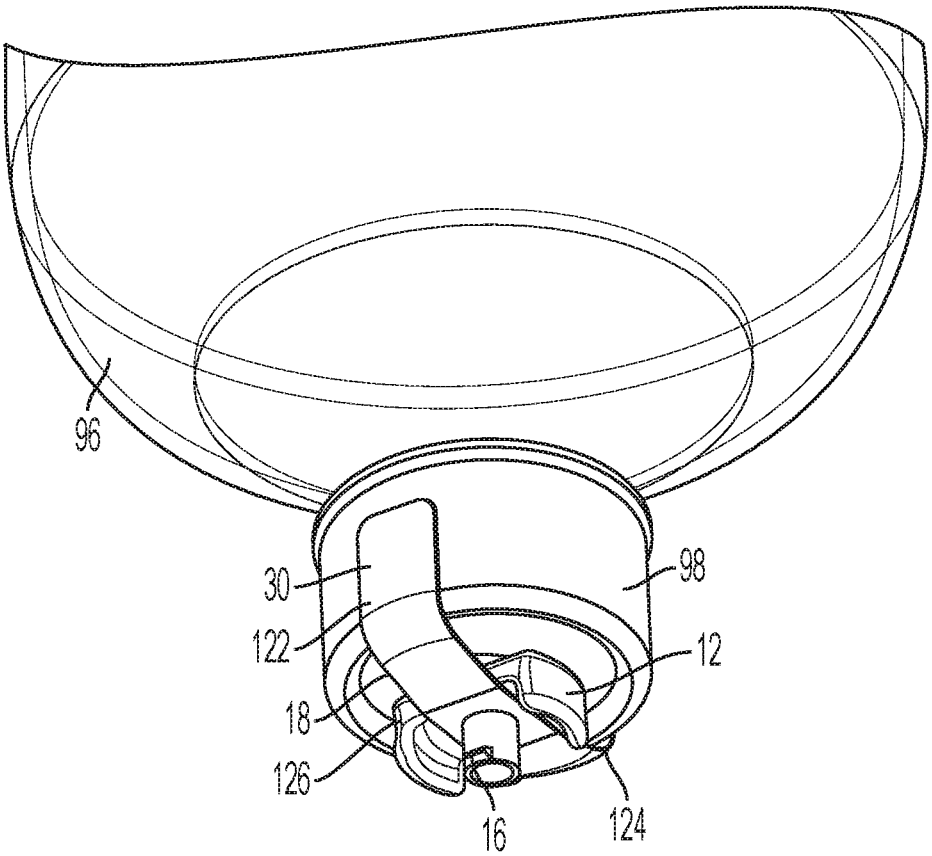
FIG. 18 is a partial perspective view of the drug transfer adapter of FIG. 17, showing the drug transfer adapter in use with a drug vial.
Figure 19:
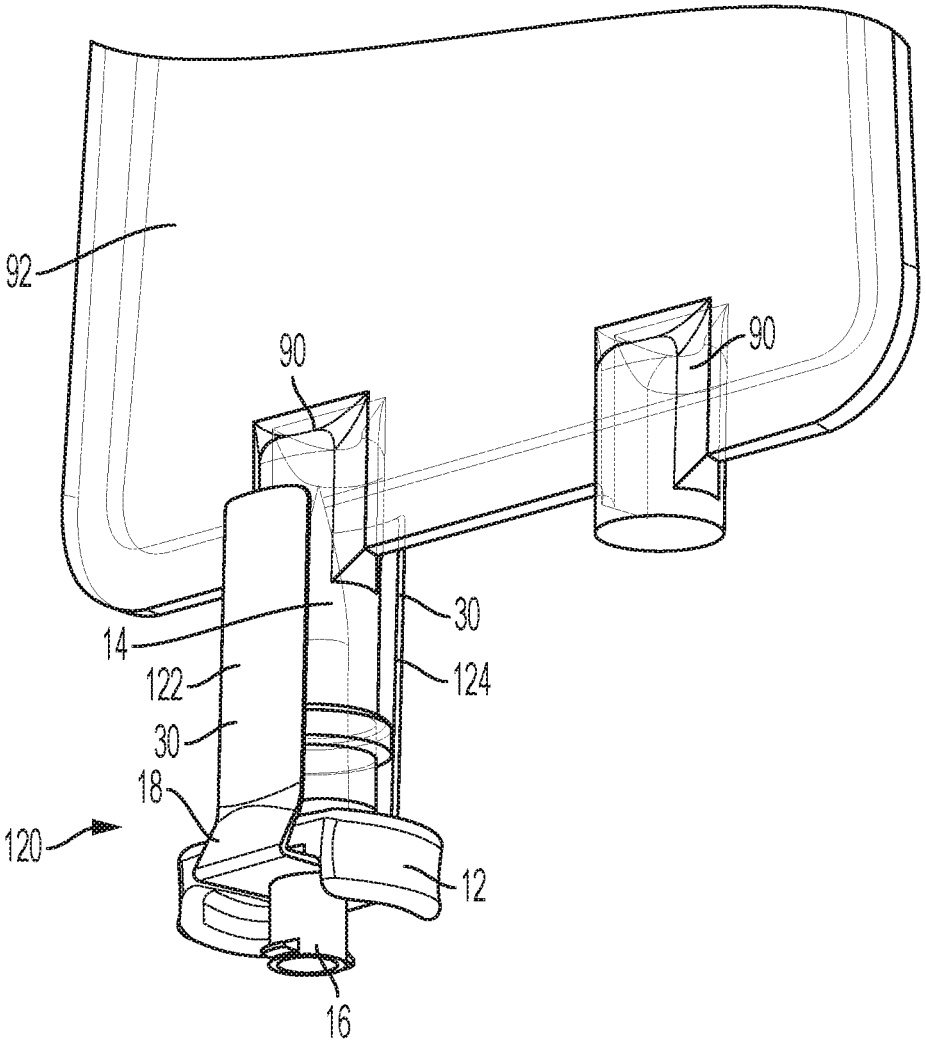
FIG. 19 is a partial perspective view of the drug transfer adapter of FIG. 17, showing the drug transfer adapter in use with an infusion container.

Referring to FIGS. 17-19, a drug transfer adapter 120 according to a sixth aspect or embodiment is shown. The drug transfer adapter 120 is similar to the drug transfer adapter 100 in FIGS. 12-14, expect for the differences discussed below. Rather than provide a single securing member 18, the drug transfer adapter 120 includes two securing members 122, 124 in a similar manner as the drug transfer adapter 10 shown in FIGS. 1-3. A first securing member 122 and a second securing member 124 define an opening 126 that receives the connector 16. As shown in FIG. 18, the drug transfer adapter 120 is connected to the drug vial 96 in a similar manner as the drug transfer adapter 80 discussed above and shown in FIG. 11. The transfer spike 14 pierces a closure of the drug vial 96 such that the transfer spike 14 is in fluid communication with the drug vial 96 and the extension portion 30 of the securing member 18 is pressed onto a portion of the drug vial 96 to secure the drug transfer adapter 120 to the drug vial 96 via engagement of the adhesive surface of the securing member 18 with the drug vial 96. As shown in FIG. 19, in securing the drug transfer adapter 120 to the IV bag 92, the transfer spike 14 pierces a closure of the spike port 90 with at least a portion of the transfer spike 14 received within the spike port 90. After the transfer spike 14 is inserted into the spike port 90, the extension portions 30 of the securing members 122, 124 are pressed onto the spike port 90 of the IV bag 92 to secure the drug transfer adapter 120 to the IV bag 92 via engagement of the adhesive surface on the securing members 122, 124 with the spike port 90. The extension portions 30 of the securing members 122, 124 are aligned with a longitudinal axis of the transfer spike 14.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims. To the extent possible, one or more features of any aspect or embodiment discussed above can be combined with one or more features of any other aspect or embodiment.

What is claimed is:

1. A drug transfer adapter comprising:

a body having a first end and a second end positioned opposite the first end;

a transfer spike extending from the body and defining an opening, the transfer spike configured to pierce a closure of a container;

a connector extending from the body; and a securing member extending from the body, the securing member having a first side and a second side positioned opposite the first side, wherein the first side of the securing member comprises an adhesive surface configured to secure the body to the container, wherein the securing member is flexible and configured to allow the securing member to be wrapped around the container or a portion of the container, and wherein the securing member has a first position where the adhesive surface is configured to be engaged with the container when the transfer spike has pierced the closure of the container and a second position where the adhesive surface is configured to be spaced from the container when the transfer spike has pierced the closure of the container, wherein the securing member is moveable 90 degrees between the first position and the second position of the securing member relative to a longitudinal axis of the transfer spike.

2. The drug transfer adapter of claim 1, wherein the securing member comprises an extension portion extending from the body, a tapered portion extending from the extension portion, and a rectangular portion extending from the tapered portion.

3. The drug transfer adapter of claim 2, wherein the rectangular portion is wider than the extension portion.

4. The drug transfer adapter of claim 1, wherein the transfer spike extends from the first end of the body.

5. The drug transfer adapter of claim 4, wherein the connector extends from the second end of the body.

6. The drug transfer adapter of claim 1, wherein the body is rectangular, the body including a first grip surface and a second grip surface positioned opposite the first grip surface.

7. The drug transfer adapter of claim 6, wherein the first and second grip surfaces are each arcuate.

8. The drug transfer adapter of claim 1, wherein the body is disc-shaped.

9. The drug transfer adapter of claim 1, wherein the body is cylindrical with a sidewall extending between the first end and the second end of the body.

10. The drug transfer adapter of claim 9, wherein the connector extends from the body at a position intermediate the first and second ends of the body.

11. The drug transfer adapter of claim 9, wherein the body includes a first grip surface and a second grip surface positioned opposite the first grip surface, and wherein the first and second grip surfaces are each arcuate.

12. The drug transfer adapter of claim 9, wherein the securing member comprises an extension portion extending from the body, a tapered portion extending from the extension portion, and a rectangular portion extending from the tapered portion.

13. The drug transfer adapter of claim 9, wherein the extension portion of the securing member extends along the sidewall of the body.

14. The drug transfer adapter of claim 13, wherein the adhesive surface of the extension portion of the securing member is in contact with the sidewall of the body to secure the securing member to the body.

15. The drug transfer adapter of claim 1, wherein the securing member comprises a first securing member and a second securing member positioned opposite the first securing member.

16. The drug transfer adapter of claim 15, wherein the first securing member and the second securing member are formed integrally.

17. The drug transfer adapter of claim 16, wherein the first securing member and the second securing member define an opening that receives the connector, a portion of the adhesive surface of the first side of the first and second securing members is in contact with the body to secure the first and second securing members to the body.

18. The drug transfer adapter of claim 1, wherein the securing member has a length of at least 50 percent of a length of the transfer spike.

19. The drug transfer adapter of claim 1, wherein the securing member has a length of at least 90 percent of a length of the transfer spike.

20. The drug transfer adapter of claim 1, wherein the securing member is formed from adhesive tape.

* * * * *